US010045108B2

(12) United States Patent
Lee et al.

(10) Patent No.: US 10,045,108 B2
(45) Date of Patent: Aug. 7, 2018

(54) EARPHONE DEVICE WITH A MICROPHONE

(71) Applicant: CRESYN CO., LTD., Seoul (KR)

(72) Inventors: Jong Bae Lee, Seoul (KR); Se Hong Oh, Seongnam-si (KR)

(73) Assignee: CRESYN CO., LTD., Seoul (KR)

( * ) Notice: Subject to any disclaimer, the term of this patent is extended or adjusted under 35 U.S.C. 154(b) by 0 days.

(21) Appl. No.: 15/001,850

(22) Filed: Jan. 20, 2016

(65) Prior Publication Data

US 2016/0142806 A1 May 19, 2016

Related U.S. Application Data

(63) Continuation of application No. PCT/KR2014/003342, filed on Apr. 17, 2014.

(30) Foreign Application Priority Data

Aug. 21, 2013 (KR) ..... 10-2013-0099152

(51) Int. Cl.
*H04R 25/00* (2006.01)
*H04R 1/10* (2006.01)

(52) U.S. Cl.
CPC ..... *H04R 1/1016* (2013.01); *H04R 1/1075* (2013.01); *H04R 25/456* (2013.01)

(58) Field of Classification Search
CPC ... H04R 1/1016; H04R 25/456; H40R 1/1075
USPC ..... 381/375
See application file for complete search history.

(56) References Cited

U.S. PATENT DOCUMENTS 5,909,498 A * 6/1999 Smith ..... H04R 1/1016 381/375
7,388,960 B2 6/2008 Kuo et al.
8,483,401 B2 7/2013 Sampimon et al.
2006/0159279 A1 7/2006 Kuo et al.
2008/0298624 A1* 12/2008 Jeong ..... H04R 1/1091 381/380

(Continued)

FOREIGN PATENT DOCUMENTS

CN 2435886 Y 6/2001
JP 2005-277792 A 10/2005

(Continued)

*Primary Examiner* — Sean H Nguyen
(74) *Attorney, Agent, or Firm* — Jefferson IP Law, LLP

(57) ABSTRACT

An earphone device is provided. The earphone device includes a pair of earphone modules. At least one of the earphone modules includes a microphone, a speaker, and a housing configured to accommodate the microphone and the speaker in an inner space thereof. The housing includes a path hole to allow the inner space to communicate outside of the housing to facilitate sound outside of the housing to enter the microphone or sound generated by the speaker to travel outside of the housing, and a partition element to partition the path hole of the housing into a first passageway and a second passageway, the first and second passageways being isolated from each other. The microphone or the speaker is housed inside the partition element. The speaker is spaced apart from the microphone at a predetermined interval and arranged to be side by side with the microphone.

9 Claims, 2 Drawing Sheets

(56) References Cited

U.S. PATENT DOCUMENTS

| | | | | |
|---|---|---|---|---|
| 2010/0215198 | A1* | 8/2010 | Ngia | H04R 1/1016 381/309 |
| 2010/0316225 | A1* | 12/2010 | Saito | H04R 1/1083 381/56 |
| 2012/0087510 | A1 | 4/2012 | Sampimon et al. | |
| 2014/0348346 | A1* | 11/2014 | Fukuda | H04R 1/1016 381/151 |
| 2015/0023542 | A1* | 1/2015 | Shimizu | H04R 1/1075 381/380 |
| 2015/0150728 | A1* | 6/2015 | Duvall | H04R 1/1016 128/865 |

FOREIGN PATENT DOCUMENTS

| | | | |
|---|---|---|---|
| JP | 2008-283326 | A | 11/2008 |
| JP | 4781850 | B2 | 9/2011 |
| KR | 10-2003-0028957 | A | 4/2003 |
| KR | 10-2004-0003096 | A | 1/2004 |
| KR | 10-1092958 | B1 | 12/2011 |
| KR | 10-1469908 | B1 | 12/2014 |

* cited by examiner

[Fig. 1]
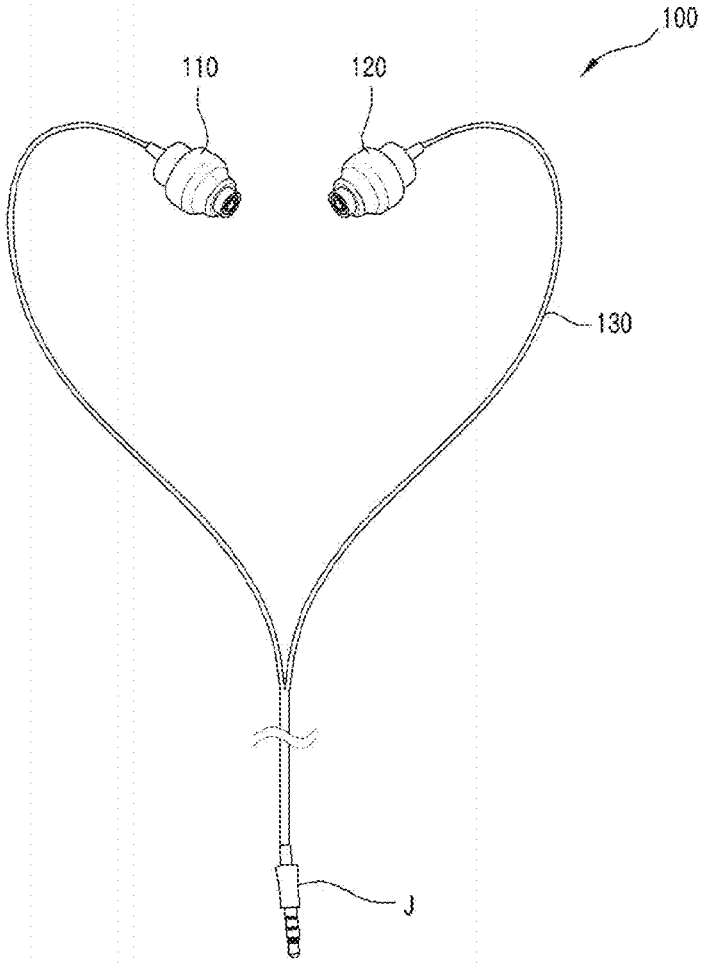
[Fig. 2]
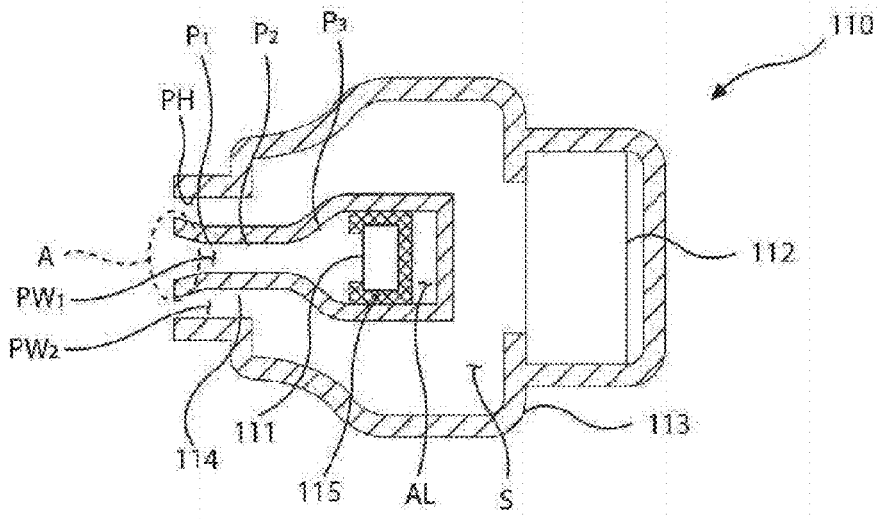

[Fig. 3]
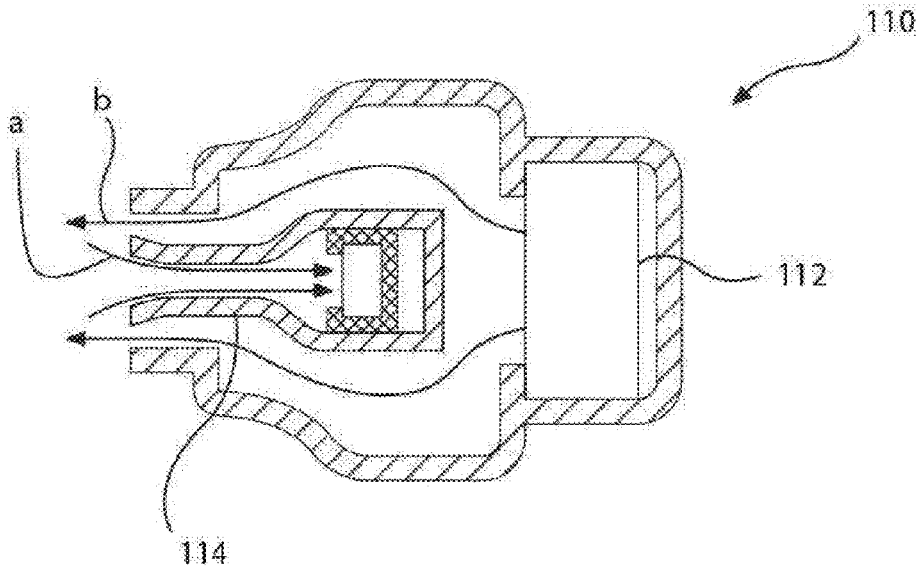
[Fig. 4]
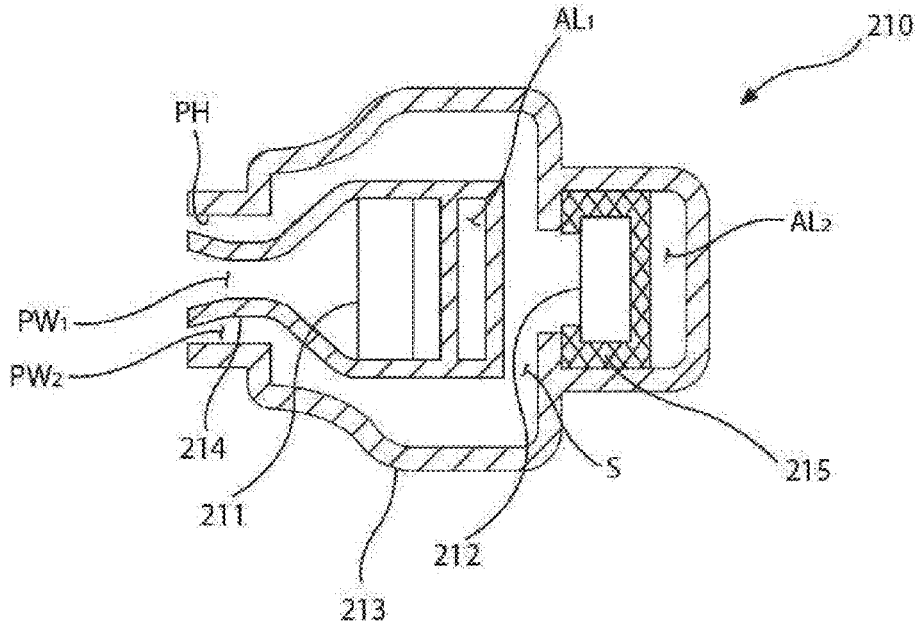

EARPHONE DEVICE WITH A MICROPHONE

CROSS-REFERENCE TO RELATED APPLICATION(S)

This application is a continuation application, claiming the benefit under § 365(c), of an International application filed on Apr. 17, 2014 and assigned application number PCT/KR2014/003342, which claimed the benefit of a Korean patent application filed on Aug. 21, 2013 in the Korean Intellectual Property Office and assigned Serial number 10-2013-0099152, the entire disclosure of which is hereby incorporated by reference.

TECHNICAL FIELD

The present disclosure relates to earphones having a microphone formed integrally.

BACKGROUND ART

Mobile phones keep evolving to carry out innovative functions which are usable in users' lives due to the intimate relations between the mobile phones and the users. Especially, owing to tremendous spread of smart phones evolved to have the computer functions, mobile phones have various functions, such as listening to music, watching videos and playing motion picture games, as well as the voice call and text communication functions of the mobile phones.

When a user uses various functions requiring sound generation using the mobile phone, the user uses earphones not to cause a noise damage to others.

Moreover, earphones are required to hear a clear sound isolated from outside noise when the user makes a voice call. Therefore, there are earphones equipped with a microphone such that a user can make a voice call with earphones in.

In general, the microphone may be mounted on a cable of the earphones or an earphone module. Out of them, the earphones according to the present disclosure are earphones having such a microphone mounted on the earphone module.

In connection with technology to mount the microphone on the earphone module, there is Korean Patent No. 10-1092958 entitled an 'earset' (hereinafter, called 'prior art').

According to the prior art, the earset includes a soundproof member inside a housing, and a microphone and a speaker arranged in parallel.

However, such a prior art has the following problems.

First, the earset which has the microphone and the speaker combined to the soundproof member deteriorates productivity because manufacturing costs are increased and there is a difficulty in the assembly.

Second, the earset is restricted in a space to mount the microphone and the speaker in consideration of the size of the earphone module and deteriorates reliability of products due to degradation of the speaker performance.

SUMMARY

Aspects of the present disclosure are to address at least the above-mentioned problems and/or disadvantages and to provide at least the advantages described below. Accordingly, the present disclosure has been made in an effort to solve the above-mentioned problems occurring in the prior arts, and it is an aspect of the present disclosure to provide earphones which have a simple structure even though a microphone is mounted on an earphone module.

It is another aspect of the present disclosure to provide earphones which can maximize a mounting space of a speaker.

According to an aspect of the present disclosure, earphones are provided. The earphones includes a pair of earphone modules, each of which converts an electrical signal into a sound signal and outputs the sound signal; and a cable for transferring the electrical signal to the pair of earphone modules, wherein one of the earphone modules includes: a microphone for converting a sound into an electrical signal; a speaker for converting the electrical signal received through the cable into a sound; a housing which accommodates the microphone and the speaker in an inner space thereof, the housing having a path hole which makes the inner space communicate with the outside so as to make the outside sound come into the microphone or makes the sound generated from the speaker go out; and a partition element for partitioning the path hole of the housing into a first passageway and a second passageway which are blocked from each other. The first passageway makes the outside sound move toward the microphone, and the second passageway makes the sound generated from the speaker move to the outside, and the speaker is spaced apart from the microphone at a predetermined interval in such a way as to be arranged side by side with the microphone and arranged farther from a user's earhole than the microphone.

The partition element is formed in such a way that the second passageway surrounds the first passageway.

The partition element is formed in a cylindrical shape and has different spans at three or more points.

The partition element is formed integrally with the housing.

A sealed air layer is disposed between the microphone and the speaker.

In another aspect of the present disclosure, the present disclosure provides earphones including: a pair of earphone modules, each of which converts an electrical signal into a sound signal and outputs the sound signal; and a cable for transferring the electrical signal to the pair of earphone modules, wherein one of the earphone modules includes: a speaker for converting the electrical signal received through the cable into a sound; a microphone for converting a sound into an electrical signal; a housing which accommodates the speaker and the microphone in an inner space thereof, the housing having a path hole which makes the inner space communicate with the outside so as to make the sound generated from the speaker go out or to make the outside sound come into the microphone; and a partition element for partitioning the path hole of the housing into a first passageway and a second passageway which are blocked from each other. The first passageway makes the sound generated from the speaker move to the outside and the second passageway makes the outside sound move toward the microphone, and the microphone is spaced apart from the speaker at a predetermined interval in such a way as to be arranged side by side with the speaker and arranged farther from a user's earhole than the speaker.

A sealed air layer is disposed at the rear of the microphone.

The partition element is formed in such a way that the second passageway surrounds the first passageway.

The partition element is formed in a cylindrical shape and has different spans at three or more points.

The partition element is formed integrally with the housing.

A sealed air layer is disposed between the microphone and the speaker.

The earphones according to the present disclosure has the following effects.

First, the earphones enhances productivity because it has a simple structure, is easy to assemble and reduces manufacturing costs.

Second, the earphones can maximize mounting spaces of the microphone and the speaker because the microphone and the speaker are arranged in series based on the user's earhole direction, so that the user can use the existing microphone and speaker proved in their performances, thereby enhancing reliability of the products.

Third, the earphones can minimize sound interference between the microphone and the speaker by the air layer, thereby enhancing reliability of the products.

BRIEF DESCRIPTION OF DRAWINGS

The above and other aspects, features, and advantages of certain embodiments of the present disclosure will be more apparent from the following description taken in conjunction with the accompanying drawings, in which:

FIG. 1 is a perspective view of earphones according to a first embodiment of the present disclosure.

FIG. 2 is a schematically sectional view of an earphone module applied to the earphones of FIG. 1.

FIG. 3 is a reference view for showing the earphone module of FIG. 2.

FIG. 4 is a schematically sectional view of an earphone module applied to earphones according to a second embodiment of the present disclosure.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Reference will be now made in detail to the various embodiments of the present disclosure with reference to the attached drawings. For conciseness and clarification of descriptions, repeated or known technologies will be omitted or compressed.

As shown in FIG. 1, earphones 100 according to a first embodiment of the present disclosure includes a pair of earphone modules 110 and 120 and a cable 130.

The pair of earphone modules 110 and 120 respectively convert an electrical signal received through the cable 130 into a sound and output the sound. One of the earphone modules 110 and 120 has a microphone which will be described later.

The cable 130 has a jack (J) connected with a mobile phone and transfers the electrical signal to the pair of earphone modules 110 and 120.

As shown in FIG. 2, the earphone module 110 which is disposed on one of the earphone modules 110 and 120 includes a microphone 111, a speaker 112, a housing 113, a partition wall 114 and an elastic rubber 115.

The microphone 111 converts a sound received from the outside into an electrical signal. The converted electrical signal is sent to a mobile phone through the cable 130.

The speaker 112 converts the electrical signal received through the cable 130 into a sound and outputs the sound. Such a speaker 112 is spaced apart from the microphone 111 at a predetermined interval in such a way as to be arranged side by side with the microphone 111 and arranged farther from a user's earhole than the microphone 111. That is, the microphone 111 and the speaker 112 are arranged side by side with each other in such a way as to be located in series in order of the user's earhole, the microphone 111 and the speaker 112.

The housing 113 accommodates the microphone 111 and the speaker 112 in an inner space S thereof. Such a housing 113 has a path hole PH which makes the inner space S communicate with the outside so as to make the outside sound come into the microphone 111 or to make the sound generated from the speaker 112 go out.

The partition wall 114 serves as a partition element to divide the path hole PH into a first passageway $PW_1$ and a second passageway $PW_2$. Such a partition wall 114 blocks the first passageway $PW_1$ and the second passageway $PW_2$ from each other. Therefore, the first passageway $PW_1$ makes the outside sound move toward the microphone 111, and the second passageway $PW_2$ makes the sound generated from the speaker 112 move to the outside. Of course, it is preferable that the partition wall 114 be injection-molded integrally with the housing 113.

Furthermore, it is preferable that the partition wall 114 be formed in a cylindrical shape so that second passageway $PW_2$ can surround the first passageway $PW_1$. Moreover, in order to collect the outside sound into the microphone 111 or output the sound generated from the speaker 112 to the outside, more preferably, the partition wall 114 has different spans at three or more points P1, P2 and P3, because there is a need to design a width of a part A which comes into contact with the outside in consideration of sizes of the microphone 111 and the speaker 112, collection efficiency of the outside sound, and output efficiency of the generated sound.

Additionally, a sealed air layer AL which is formed using the partition wall 114 is formed between the microphone 111 and the speaker 112. Such an air layer AL reduces interference of the outside sound or the sound generated from the speaker 112.

The elastic rubber 115 is disposed to surround the microphone 111. Such an elastic rubber 115 serves as a sound-absorbing material to reduce interference of the outside sound or the sound generated from the speaker 112.

According to the earphone module 110, as shown in FIG. 3, the outside sound goes toward the microphone 111 (see the arrow a in FIG. 3) through the first passageway $PW_1$, but the sound generated from the speaker 112 goes out (see the arrow b in FIG. 3) through the second passageway $PW_2$. Therefore, the sound generated from the speaker 112 does not have any influence on the microphone 111.

As shown in FIG. 4, an earphone module 210 applied to earphones according to a second embodiment of the present disclosure includes a speaker 211, a microphone 212, a housing 213, a partition wall 214 and an elastic rubber 215.

The speaker 211 converts the electrical signal received through the cable into a sound and outputs the sound.

The microphone 212 converts a sound received from the outside into an electrical signal. The converted electrical signal is sent to a mobile phone through the cable. Such a microphone 212 is spaced apart from the speaker 211 at a predetermined interval in such a way as to be arranged side by side with the speaker 211 and arranged farther from a user's earhole than the speaker 211. That is, the speaker 211 and the microphone 212 are arranged side by side with each other in such a way as to be located in series in order of the user's earhole, the speaker 211 and the microphone 212.

The housing 213 accommodates the speaker 211 and the microphone 212 in an inner space S thereof. Such a housing 213 has a path hole PH which makes the inner space S communicate with the outside so as to make the outside sound come into the microphone 212 or to make the sound generated from the speaker 211 go out.

The partition wall 214 serves as a partition element to divide the path hole PH into a first passageway $PW_1$ and a second passageway $PW_2$. The first passageway $PW_1$ makes the sound generated from the speaker 211 move to the outside, and the second passageway $PW_2$ makes the outside sound move toward the microphone 212.

Likewise, it is preferable that the partition wall 214 be injection-molded integrally with the housing 213 and be formed in a cylindrical shape so that the second passageway $PW_2$ can surround the first passageway $PW_1$. Of course, preferably, the partition wall 214 has different spans at three or more points.

Additionally, a first sealed air layer $AL_1$ which is formed using the partition wall 214 is formed between the speaker 211 and the microphone 212, and a second sealed air layer $AL_2$ is formed at the rear of the microphone 212. The first air layer $AL_1$ minimizes that rear vibration of the speaker 211 interferes in the microphone 212, and the second air layer $AL_2$ reduces interference between the outside noise and the sound generated from the speaker 211.

The elastic rubber 215 is disposed to surround the microphone 212.

According to the earphone module 210, the outside sound goes toward the microphone 212 through the second passageway $PW_2$, but the sound generated from the speaker 211 goes out through the first passageway $PW_1$.

As described above, while the present disclosure has been particularly shown and described with reference to the example embodiments thereof, it will be understood by those of ordinary skill in the art that the above embodiments of the present disclosure are all exemplified and the present disclosure is not limited to the above embodiments. Therefore, it would be understood that the technical and protective scope of the present disclosure shall be defined by the technical idea as defined by the following claims and the equivalences.

EXPLANATION OF REFERENCE NUMERALS IN DRAWINGS

100: earphones
110, 120, 210: earphone module
111, 212: microphone
112, 211: speaker
113, 213: housing
114, 214: partition wall
S: inner space
PH: path hole
$PW_1$: first passageway, $PW_2$: second passageway
AL: air layer
$AL_1$: first air layer, $AL_2$: second air layer

What is claimed is:

1. An earphone device comprising:
a pair of earphone modules, each of the earphone modules being configured to:
convert an output electrical signal into an output sound, and
output the output sound; and
a cable configured to transfer the output electrical signal to the pair of earphone modules,
wherein at least one of the earphone modules comprises:
a microphone configured to convert an input sound into an input electrical signal,
a speaker configured to convert the output electrical signal received through the cable into the output sound,
a housing configured to accommodate the microphone and the speaker in an inner space thereof, the housing comprising a path hole configured to allow the inner space to communicate outside of the housing to facilitate the input sound to enter the microphone from outside of the housing or facilitate the output sound generated by the speaker to travel outside of the housing, and
a partition element configured to partition the path hole of the housing into a first passageway and a second passageway, the first and second passageways being isolated from each other,
wherein the first passageway is configured to guide the input sound from the outside of the housing toward the microphone,
wherein the second passageway is configured to guide the output sound generated from the speaker to the outside of the housing,
wherein the microphone is housed inside the partition element,
wherein the second passageway surrounds the first passageway, and
wherein the microphone is further configured to be:
spaced apart from the speaker at a predetermined interval and arranged to be side by side with the speaker, and
inserted deeper into a user's ear than the speaker.

2. The earphone device according to claim 1, wherein the partition element comprises:
a cylindrical shape, and
a plurality of different spans at three or more points.

3. The earphone device according to claim 1, wherein the partition element is formed integrally with the housing.

4. The earphone device according to claim 1, further comprising:

a sealed air layer disposed between the microphone and the speaker.

5. An earphone device comprising:

a pair of earphone modules, each of the earphone modules being configured to:

convert an output electrical signal into an output sound, and output the output sound; and a cable configured to transfer the output electrical signal to the pair of earphone modules, wherein at least one of the earphone modules comprises:

a speaker configured to convert the electrical signal received through the cable into sound, a microphone configured to convert an input sound into an input electrical signal, a housing configured to accommodate the speaker and the microphone in an inner space thereof, the housing comprising a path hole configured to allow the inner space to communicate outside of the housing to facilitate the output sound generated from the speaker to travel outside of the housing or to facilitate the input sound to enter the microphone, and a partition element configured to partition the path hole of the housing into a first passageway and a second passageway, the first and second passageways being isolated from each other, wherein the first passageway is configured to guide the output sound generated from the speaker to the outside of the housing, wherein the second passageway is configured to guide the input sound from the outside of the housing toward the microphone, wherein the speaker is housed inside the partition element, wherein the second passageway surrounds the first passageway, and wherein the speaker is further configured to be:

spaced apart from the microphone at a predetermined interval and arranged to be side by side with the microphone, and inserted deeper into a user's ear than the microphone.

6. The earphone device according to claim 5, further comprising:

a sealed air layer disposed at a rear of the microphone.

7. The earphone device according to claim 5, wherein the partition element comprises:

a cylindrical shape, and a plurality of different spans at three or more points.

8. The earphone device according to claim 5, wherein the partition element is formed integrally with the housing.

9. The earphone device according to claim 5, further comprising:

a sealed air layer disposed between the microphone and the speaker.

* * * * *